United States Patent [19]

Trager

[11] 4,427,472

[45] Jan. 24, 1984

[54] APPLIQUE METHOD

[76] Inventor: Rosemary Trager, 1120 Elm St., Chillicothe, Mo. 64601

[21] Appl. No.: 427,360

[22] Filed: Sep. 29, 1982

[51] Int. Cl.[3] ..... B28B 7/08

[52] U.S. Cl. ..... 156/93; 156/267; 156/299; 156/234; 156/277; 112/402; 112/405; 112/440; 428/79; 428/102; 428/104; 428/914

[58] Field of Search ..... 156/93, 267, 234, 299, 156/277; 428/79, 102, 104, 914; 112/401, 402, 112/405, 440

[56] References Cited

U.S. PATENT DOCUMENTS

| | | | |
|---|---|---|---|
| 1,723,729 | 8/1929 | Goldberg | 112/405 |
| 4,284,456 | 8/1981 | Hare | 428/914 |

*Primary Examiner*—Edward C. Kimlin
*Assistant Examiner*—Timothy W. Heitbrink
*Attorney, Agent, or Firm*—Griffin, Branigan & Butler

[57] ABSTRACT

A secondary pattern 40 having a mirror image relationship to an applique design of a primary pattern is produced and adhered to the underside 20*b* of a background fabric 20. Crudely cut segments 42 of fabric material are positioned on the upperside 20*a* of the background fabric 20 and sewed thereto with a thread of contrasting color in accordance with the secondary pattern 40 on the underside of the background fabric 20. The stitches 44 produced with the contrasting thread are used as precision guides for trimming excess portions of the fabric segments 42 so that each piece assumes its desired shape in accordance with the primary pattern. The stitches 44 produced by sewing with the contrasting thread are also used as precision guides for final applique stitching 50 with a further thread to secure each design component fabric piece (22, 24, 26, 28) to the background fabric and, where desirable, to conceal stitches 44 made with the contrasting thread.

3 Claims, 8 Drawing Figures

APPLIQUE METHOD

BACKGROUND OF THE INVENTION

This invention concerns an improved machine applique method.

Appliques are created by a process of applying a plurality of fabric pieces, preferably of varying colors or textures, to a background fabric in order to form an attractive ornamental or artistic design on the background fabric. The design produced on the background fabric is generally derived from a printed pattern or the like. In this respect, numerous printed pattern packages featuring myriads of designs are commercially available. Each printed pattern package includes an instruction sheet typically having thereon both (1) an essentially full scale traceable drawing of the complete design (referred to hereinafter as a placement pattern) and (2) a plurality of segmented traceable drawings of pattern pieces which form portions of the overall design.

Some conventional applique methods are begun by forming an image or copy of the entire design on or over an upperside of the background fabric. This may be done in several ways. For example, the design may be traced directly onto the upperside of the background fabric with the aid of a pencil and a light table. In tracing directly onto the background fabric, however, difficulties arise if the fabric tends to slide. Moreover, light tables are generally regarded as nuisances and are preferably avoided whenever possible. Also, if traced lines are too light they become barely visible. If a line is mistraced too darkly beyond the borders of the design it will appear unseemly on the finished product. Further, as seen hereinafter, copies of designs formed on or over the upperside of the background fabric tend to become covered during subsequent steps, thereby obscuring some pattern outlines which are needed for the remainder of the applique operation.

Once an image or copy of an entire design is formed on the upperside of the background fabric, individual design component fabric pieces corresponding to each of the pattern pieces are cut from selected fabric materials. The fabric materials are selected on the basis of color and texture in accordance with a desired contribution to the overall design. This cutting process involves the steps of cutting out each pattern piece from the instruction sheet; tracing each pattern piece onto the appropriate fabric material; and, cutting the design component fabric pieces from the fabric material in accordance with the trace marks. Also, a similarly shaped piece of colorless glue type material should be prepared for each pattern piece. These steps are tediously time consuming yet subject to noticeable errors and inaccuracies if not carried out carefully.

The pieces of colorless glue fabric material are used to back the corresponding design component fabric pieces. As used herein, the colorless glue material may be of a type that is sticky on both sides or sticky only on one side. For backing, purposes, a sticky side of the sticky glue material is adhered to the back of the design component fabric piece. The adhesion step may be accomplished by known techniques, such as the use of a steam iron or a damp pressing cloth, for example. This backing assists the cut fabric pieces in maintaining their position during the remainder of the process and facilitates stitching.

The design component fabric pieces, each properly backed, are next positioned on the upperside of the background fabric. Placement of the fabric may be in accordance with the placement pattern formed thereon or, if the initial step of forming a placement pattern was ignored, in accordance with personal visual judgement. Each design component fabric piece is then secured in position by one of several possible techniques: (1) ironing fabric pieces backed with two-sided glue material onto the background fabric using a steam iron; (2) gluing the back of the backed fabric piece onto the corresponding portion of the background fabric; or (3) pinning the backed fabric piece on the corresponding portion of the background fabric.

Numerous perils attend the afore-described positioning and securing steps. Laying the backed fabric pieces over the placement pattern tends to obscure or even cover critical pattern outlines. This is especially the case when the fabric pieces must be cut a little larger than they will eventually appear on the finished design in order to facilitate an overlapping of fabric pieces as required for effective stitching in applique methods. Placement of each piece, particulary subsequent pieces laid over underlying portions of fabric pieces, becomes sheer guesswork in a process which requires exactitude.

In the securing process, the fabric pieces can initially slide from an insecure backing. Moreover, even a securely backed fabric piece may slide as attempts are made to secure it to the background fabric, especially if ironing or gluing techniques are used. It is extremely difficult to remove secured fabric pieces which may have slid or otherwise been mislaid. In addition, tiny fabric pieces rarely are properly ironed or glued to the placement pattern.

The fabric pieces are all secured to the background fabric in the manner described above beginning with fabric pieces which lie further in the background of the design and building outwardly. The fabric pieces are then secured onto the background with a special applique stitch which resembles a conventional zig-zag satin stitch. The edges of the fabric pieces are used as guides for the stitching. Unfortunately, the edges of the fabric pieces form poor guides for the stitching, especially when adjacent fabric pieces are of similar color or of slightly different shades.

After hours of laborious and tedious effort in completion of the above or similar prior-art steps, a finished applique results.

In view of the foregoing disadvantages of the prior art, an object of this invention is the provision of an applique method which, while being quick and easy to use, results in accurate placement of design component fabric pieces on a background fabric.

An advantage of the invention is a method not requiring the aid of light tables or sophisticated tracing apparatus.

Another advantage of the invention is the provision of a method which does not require a pattern instruction sheet having segmented pattern pieces.

A further advantage of the invention is the provision of a method which does not require tedious exactitude in cutting out a plurality of design component fabric pieces, but which permits a rough approximation of the desired fabric piece to be utilized.

Yet another advantage of the invention is the provision of a method which does not result in the obscuring or covering of critical pattern boundary outlines.

Yet another advantage of the invention is the provision of a method which facilitate accurate placement of design component fabric pieces on the background fabric, thereby opening the field to those persons with less natural artistic talent.

Still another advantage of the invention is the provision of a method which provides clearly visible guide lines for positioning of the applique stitching.

SUMMARY

A secondary pattern having a mirror image relationship to an applique design of a primary pattern is produced and adhered to the underside of a background fabric. Crudely cut segments of fabric material are positioned on the upperside of the background fabric and sewed thereto with the thread of contrasting color in accordance with the secondary pattern on the underside of the background fabric. The stitches produced with the contrasting thread are used as precision guides for trimming excess portions of the fabric pieces so that each piece assumes its desired shape in accordance with the primary pattern. The stitches produced by sewing with the contrasting thread are also used as precision guides for final stitching with a further thread to secure each design component fabric piece to the background fabric and to conceal stitches made with the contrasting thread.

BRIEF DESCRIPTION OF THE DRAWINGS

The foregoing and other objects, features, and advantages of the invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

DETAILED DESCRIPTION OF THE DRAWINGS

Figure 1:
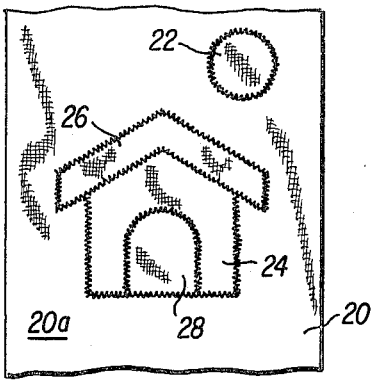
FIG. 1 is a diagram illustrating an upperside of a background fabric bearing a finished applique pattern produced by the steps of the method of the invention.

FIG. 1 illustrates a finished applique which pictures a design of a moonlit dog house on a background fabric 20. Included in the design of the applique are design component pieces 22 (a moon); 24 (a dog house frame); 26 (a dog house roof); and, 28 (a dog house door).

A first step in producing the finished applique of FIG. 1 is the production of a secondary pattern which will bear a mirror image relationship to the applique design of a primary pattern such as that which yields the finished applique of FIG. 1. To obtain a secondary pattern, a tracing medium, such as conventional tracing paper, is placed over a printed primary pattern having the design thereon which eventually results in the applique pictured in FIG. 1.

In most printed pattern packages an illustration of the entire design is provided. If, however, the pattern package has no such entire design but rather component portions of the design, an entire design can be constructed by tracing one component and then moving the tracing medium so that the already traced component lines up adjacent to a neighboring component. In this manner the neighboring component may be traced in its correct position.

Figure 2:
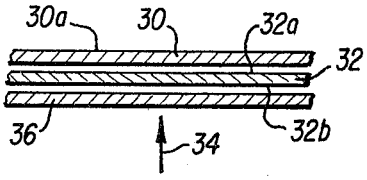
FIG. 2 is a cross-sectional diagram illustrating a step of producing a secondary pattern according to the method of the invention.

The tracing medium, labeled as 30 in FIG. 2 is then placed over an adhesive fabric material 32. The adhesive fabric material has a sticky side **32*a* and a non-sticky side 32*b*. A side 30*a* of the tracing medium which has the trace marks thereon is placed facing upwardly (the upward direction being indicated by arrow 34 in FIG. 2). A transfer medium 36, such as conventional carbon paper, for example, is placed under the non-sticky side 32*b* of the adhesive fabric material and is positioned so that depressions which will be made on side 30*a* of the tracing medium 30 will correspondingly mark the non-sticky side 32*b* of the adhesive fabric material 32** to form secondary pattern boundary outlines.

Figure 3:
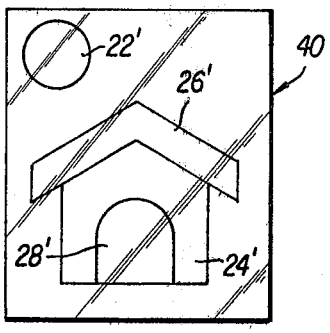
FIG. 3 is a diagram illustrating a secondary pattern produced in accordance with the method of the invention.

After the tracing medium 30, the adhesive fabric material 32, and the transfer medium 36 have been oriented in the manner depicted by FIG. 2, an object such as an empty ball point pen is guided along the already-existing trace marks on the tracing medium 30 in a retracing-type operation to provide impressions on the trace medium 30. As the impressions are made on the trace medium 30, the transfer medium 36 produces the secondary pattern 40 of FIG. 3 on the non-sticky side **32*b* of the adhesive fabric material 32. In this respect, the secondary pattern 40 of FIG. 3, seen looking in the direction of arrow 34 of FIG. 2, bears a mirror image relationship to the primary pattern which was traced upon the tracing medium 30. The secondary pattern 40 has secondary pattern component portions 22' (corresponding to the moon 22); 24' (corresponding to the dog house frame 24); 26' (corresponding to the dog house roof 26); and, 28' (corresponding to the dog house door 28). That the secondary pattern 40 is a mirror image of the primary pattern can be seen from comparing FIG. 3 to FIG. 1, and particularly noting the respective locations of the fabric piece 22 in FIG. 1 and in the secondary pattern component 22' of FIG. 3**.

Figure 4:
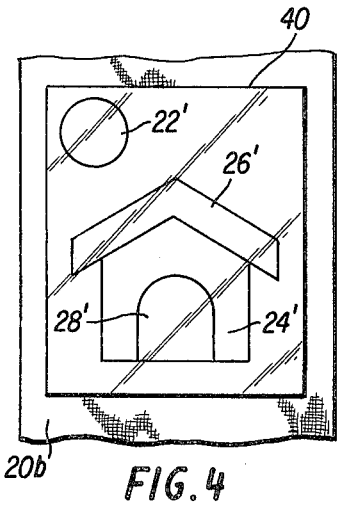
FIG. 4 is a diagram illustrating a step of the adhering a secondary pattern to the underside of a background fabric in accordance with the method of the invention.

Once the secondary pattern 40 has been prepared in the manner described above, it is next adhered to the underside **20*b* of the background fabric 20. In a preferred embodiment, the adhering step is accomplished by ironing the sticky side 32*a* of the adhesive fabric material 32 onto the underside 20*b* of the background fabric 20 as shown in FIG. 4**.

Figure 5:
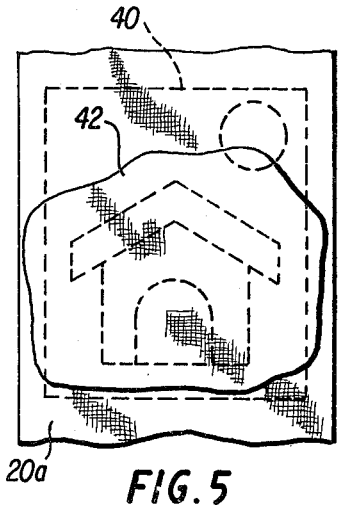
FIG. 5 is a diagram illustrating an upperside of a background fabric and a step of using a secondary pattern to position a fabric segment on the upperside of the background fabric according to the method of the invention.

Next, a fabric segment is prepared to roughly correspond with a primary pattern component portion. In this respect, FIG. 5 illustrates a fabric segment 42 prepared to eventually form the design component fabric piece 24, which is the dog house frame of the applique design under discussion. Fabric segment 42 is crudely cut from a web of selected fabric in such a manner that the fabric segment 42 is at least as large as its corresponding primary pattern component portion 24 so that a resultant fabric piece having essentially the same size as the corresponding primary pattern component portion can be formed therefrom in a manner hereinafter described. Cutting a fabric segment 42 of approximate size is easier than painstakingly cutting out a pattern piece along pattern boundary lines especially when one considers that there are usually numerous pattern pieces for each applique design.

In a preferred embodiment, a segment of sticky interfacing fabric material is prepared to have the same approximate size and shape as the fabric segment 42. The interface fabric material is then adhered to the back of the segment 42 by conventional methods discussed above, such as with a steam iron or a damp pressing cloth, for example.

Once it has been prepared, the fabric segment 42 is then positioned on the upperside 20*a* of the background fabric 20. The positioning is accomplished by holding the background fabric 20 up to a light source so that boundary outlines of the secondary pattern can be seen. In this respect, fabric segment 42 is placed over the boundary lines of the secondary pattern component portion 24' so that segment 42 is at least coextensive with the portion 24'. That is to say, the fabric segment 42 is positioned so that its coverage on the upperside 20*a* of the background fabric 20 totally includes the component portion 24' on the underside 20*b*.

Once positioned, the fabric segment 42 is then temporarily secured to the upperside 20*a* of the background fabric 20 by appropriate securing means. Securing means can include, for example, pins 46 such as those shown in FIG. 6.

Figure 6:
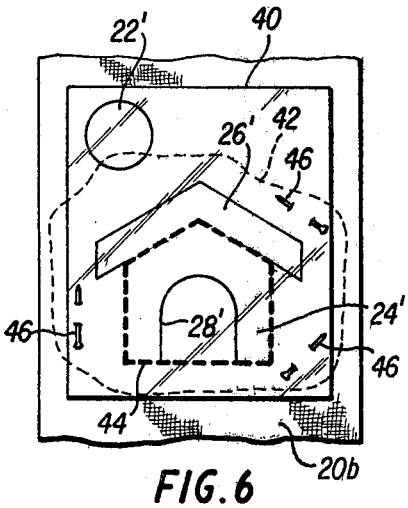
FIG. 6 is a diagram illustrating an underside of a background fabric and a step of sewing a fabric segment to the upperside of the background fabric in accordance with the method of the invention.

As is shown in FIG. 6, segment 42 is next sewed onto the upperside 20*a* of the background fabric 20. FIG. 6 shows the underside 20*b* of the background fabric 20 with the secondary pattern 40 adhered thereto. The secondary pattern boundary lines outlining each of the secondary pattern component portions 22', 24', 26', and 28' are visible on the secondary pattern 40 on the underside 20*b*. Faint dotted lines representing the irregular form of the fabric segment 42 show the placement of fabric segment 42 on the upperside 20*a* of the background fabric 20. As mentioned above, the fabric segment 42 is temporarily secured to the upperside 20*a* by the securing pins 46, three of which are shown in FIG. 6. In sewing the fabric segment 42 to the upperside 20*a* of the background fabric 20, the underside 20*a* is positioned facing upwardly and the boundary line of pattern component portion 24' is used as a guide for the stitching. Upon completion of the stitching operation the stitches appear as the boldfaced dotted lines 44 in FIG. 6. The stitches 44 are made with a thread of a color which sharply contrasts with the color of the fabric segment 42. For example, if the fabric segment 42 used for the dog house frame were of a material having a brown color, a white or red stitch 44 would be visibly apparent and contrast with the brown background. Once the fabric segment 42 is sewn onto the upperside 20*a* of the background fabric 20, the securing pins 46 can be removed therefrom.

Figure 7:
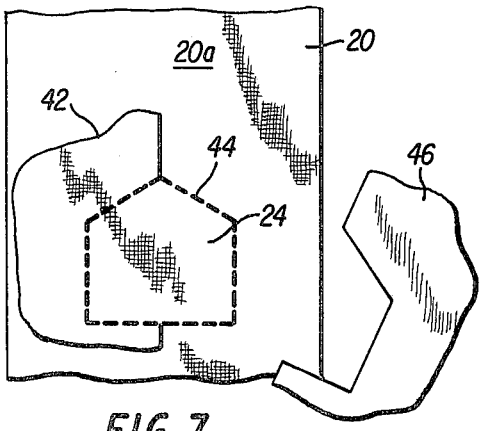
FIG. 7 is a diagram illustrating an upperside of a background fabric and a step of trimming portions of a fabric segment sewn onto the upperside of the background fabric; and, FIG. 8 is a diagram illustrative of an upperside of a background fabric and a step of securing a plurality of fabric pieces onto the background fabric.

After the entire fabric segment 42 has been sewn onto the upperside 20*a* of the background fabric 20, the fabric segment 42 is then trimmed to remove excess portions thereof which extend beyond the stitches 44. FIG. 7 shows a half complete trimming operation wherein half 46 of fabric segment has been cut away from the remainder of fabric segment 42 which is still adhered to the upperside 20*a* of the background fabric 20. In this respect, segment half 46 was removed by cutting along the stitches 44 with a small, sharp pair of scissors. During the cutting process the thread 44 serves as a precision guide for manipulation of the scissors inasmuch as the stitches 44 are of colors which contrast with the color of the fabric segment 42. The cutting operation will continue around the remainder of the stitching 44 so that the design component fabric piece 24 can be derived from the fabric segment 42.

Figure 8:
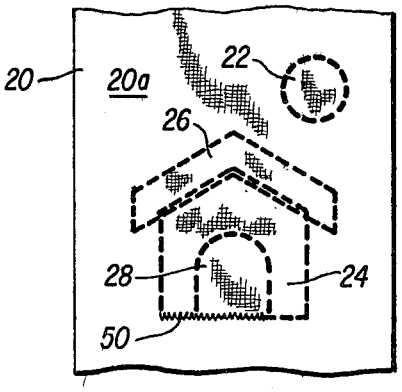

FIG. 8 shows, in addition to design component fabric piece 24, the remainder of the design fabric component pieces 22, 26, and 28 which are secured to upperside 20*a* of the background fabric 20. The order of the placement of the respective design component fabric pieces for the design shown is determined by the nature of the design and the experience of the person producing the applique. It is suggested that one first secure the design component fabric piece 24 in the manner described above; to then secure the design component piece 28 (the dog house door) over fabric piece 24; to position and secure the dog house roof 26 in a barely overlapping relationship with the dog house frame 24; and, to secure the moon 22 which stands by itself. Those skilled in the art will appreciate the requirement that adjoining design component fabric pieces overlap somewhat in order that the applique stitching with stitches 50 be effective.

It should be understood that each of the foregoing steps of the method discussed with respect to the resultant design component fabric piece 24 are applicable as well to the remaining design component fabric pieces 22, 26, and 28. That is, the method for securing each design component fabric piece includes the steps of preparing analogous backed fabric segments; positioning the backed fabric segments to the upperside 20*a* of the background fabric 20; sewing each fabric segment to the background fabric by stitching along boundary outlines on the secondary pattern 40 (the stitches used for each fabric segment being produced with a thread having color which contrasts with the thread of the particular fabric segment); and, trimming around each fabric segment in the above-described manner.

FIG. 8 further illustrates the beginning of the step of applique stitching and in particular illustrates the zig zag satin-type applique stitch which is well known in the art. In this respect, FIG. 8 shows stitching 50 on only a fraction of the base portion of design component fabric piece 24 (that is, along the base of the dog house). The color of the stitching 50 is not necessarily chosen to contrast with the color of the material used for the respective design component fabric pieces which the stitches 50 secure to the upperside 20*a* of the background fabric 20. These further stitches 50 are used to secure the trimmed design component fabric piece to the upperside 20*a* of the background fabric 20; to form an attractive border around each design component fabric piece; and, to conceal the underlying stitches 44 made with the thread of contrasting color. In this respect, the stitches 50, being of a zig zag type, are broad enough to easily conceal the stitches 44. The stitches 44, being of a visibly apparent contrast to the design component fabric piece, function as precision guides for the placement of the further stitches 50.

While the invention has been particularly shown and described with reference to the preferred embodiments thereof, it will be understood by those skilled in the art that various alterations in form and detail may be made therein without departing from the spirit and scope of the invention.

The embodiments of the invention in which an exclusive property or privilege is claimed are defined as follows:

1. A process of applying a plurality of fabric pieces to a background fabric in accordance with a design of a primary pattern for simulating said design on said background fabric using said fabric pieces, said pattern including a plurality of component portions forming said design, said process comprising the steps of:

producing a secondary pattern which bears a mirror image of said design, said secondary pattern including a plurality of neighboring secondary pattern component portions bordered by secondary pattern outlines;

adhering said secondary pattern to the underside of said background fabric;

preparing segments of fabric corresponding to said primary pattern component portions, each of said fabric segments being larger than its corresponding primary pattern component portion so that a fabric piece having essentially the same size as said corresponding primary pattern component portion can be formed therefrom;

using said secondary pattern adhered to said underside of said background fabric to position at least one of said fabric segments on the upperside of said background fabric so that said fabric segment is at least coextensive with a corresponding secondary pattern component portion on the underside of said background fabric;

temporarily securing said fabric segment to said upperside of said background fabric;

sewing said fabric segment to said background fabric by stitching along said secondary pattern outlines which border the corresponding secondary pattern component portion for said fabric segment, said stitching being done with a first thread;

trimming said fabric segment sewn to said upperside of said background fabric to remove excess portions thereof which extend beyond the stitches produced by said sewing with said first thread, thereby producing trimmed fabric pieces; and, using said stitches produced by sewing with said first thread as guides for sewing further stitches, said further stitches being used to secure said trimmed fabric pieces to said upperside of said background fabric and where appropriate to conceal said stitches made with said first thread.

2. The method of claim 1, wherein said step of producing said secondary pattern includes the steps of:

tracing said primary pattern on tracing medium;

positioning an adhesive fabric between said tracing medium and a sheet of transfer medium, said adhesive fabric material having a sticky side and a non-sticky side, said sticky side of said adhesive fabric material being oriented toward said tracing medium and said transfer medium being positioned so that depressions made on said tracing medium correspondingly mark the non-sticky side of said adhesive fabric material; and, making impressions on said tracing material in accordance with said primary pattern to form said secondary pattern on said non-sticky side of said adhesive fabric material.

3. The method of claim 1, wherein said first thread is thread of a color which contrasts with the color of said fabric segment.

* * * * *